US006514568B1

(12) United States Patent
Nagano et al.

(10) Patent No.: US 6,514,568 B1
(45) Date of Patent: Feb. 4, 2003

(54) METHOD OF FORMING MULTILAYERED TOPCOAT FILM

(75) Inventors: Hiroyuki Nagano, Nagoya (JP); Hideo Sugai, Hiratsuka (JP); Yasumasa Okumura, Yokohama (JP)

(73) Assignee: Kansai Paint Co., Ltd., Amagasaki (JP)

( * ) Notice: Subject to any disclaimer, the term of this patent is extended or adjusted under 35 U.S.C. 154(b) by 0 days.

(21) Appl. No.: 09/600,587

(22) PCT Filed: Jan. 22, 1999

(86) PCT No.: PCT/JP99/00243

§ 371 (c)(1),
(2), (4) Date: Jul. 19, 2000

(87) PCT Pub. No.: WO99/37410

PCT Pub. Date: Jul. 29, 1999

(30) Foreign Application Priority Data

Jan. 23, 1998 (JP) ..... 10-010963

(51) Int. Cl.[7] ..... B05D 1/36; B05D 3/02; B05D 7/16

(52) U.S. Cl. ..... 427/407.1; 427/409; 427/410

(58) Field of Search ..... 428/461, 626; 427/27, 195, 202, 407.1, 409; 525/111, 113, 118

(56) References Cited

U.S. PATENT DOCUMENTS

| | | | | | |
|---|---|---|---|---|---|
| 3,639,147 | A | * | 2/1972 | Benefiel et al. | 427/389.7 |
| 4,139,672 | A | * | 2/1979 | Ozawa et al. | 204/488 |
| 4,276,392 | A | * | 6/1981 | Chattha | 427/386 |
| 4,981,759 | A | * | 1/1991 | Nakatani et al. | 204/486 |
| 5,609,918 | A | * | 3/1997 | Yamaguchi et al. | 427/407.1 |
| 5,663,240 | A | * | 9/1997 | Simeone et al. | 525/165 |
| 6,200,639 | B1 | * | 3/2001 | Duecoffre et al. | 427/386 |

FOREIGN PATENT DOCUMENTS

| | | | | |
|---|---|---|---|---|
| JP | 3-229674 | | 10/1991 | |
| JP | 3229674 | A * | 11/1991 | B05D/7/24 |
| JP | 4-18967 | | 1/1992 | |
| JP | 5-38482 | | 2/1993 | |
| JP | 5-138115 | | 6/1993 | |
| JP | 6-88056 | | 3/1994 | |
| WO | WO 98/27172 | * | 6/1998 | C09D/133/00 |

* cited by examiner

*Primary Examiner*—Shrive P. Beck
*Assistant Examiner*—William Phillip Fletcher, III
(74) *Attorney, Agent, or Firm*—Armstrong, Westerman & Hattori, LLP

(57) ABSTRACT

Disclosed is a 3-coat 2-bake method of forming a multilayered topcoat film, comprising applying a first coating composition (A) and a second coating composition (B) to a substrate, thermally curing the two compositions, and applying and thermally curing a clear coating composition (C);

the first coating composition (A) being an organic solvent-based colored coating composition;

the second coating composition (B) being an organic solvent-based coating composition comprising an acrylic resin (b-1) having at least two side chains of different lengths, each of which is bonded to the main chain and has at least one hydroxyl group, a polyepoxide (b-2) and a crosslinking agent (b-3); and the clear coating composition (C) being a powder coating composition (C-1) or an organic solvent-based coating composition (C-2) comprising a hydroxyl- and carboxyl-containing resin (c-2*a*) and a polyepoxide (c-2*b*). The method of the present invention is capable of forming a multilayered topcoat film excellent in intercoat adhesion, finish properties and film performance.

9 Claims, No Drawings

METHOD OF FORMING MULTILAYERED TOPCOAT FILM

TECHNICAL FIELD

The present invention relates to a novel method of forming a multilayered topcoat film.

BACKGROUND ART

A 3-coat 2-bake method of forming a multilayered topcoat film on an automotive outer plate or the like is known, which comprises applying a first coating composition and a second coating composition to a substrate usually coated with an undercoat, such as a cationic electrodeposition coat, and an intermediate coat, thermally curing the first and second coating compositions, and applying and thermally curing a clear coating composition.

The clear coating composition used for the above method is usually an organic solvent-based coating composition comprising a hydroxyl-containing acrylic resin and a melamine resin, a powder coating composition, an organic solvent-based coating composition to be cured by crosslinking between a carboxyl group and an epoxy group.

However, it was found that when the 3-coat 2-bake method employs, as the clear coating composition, a powder coating composition or an organic solvent-based coating composition to be cured by crosslinking between a carboxyl group and an epoxy group, the method has the drawback that, if the coating surface of the second coating composition is not sanded before application of the clear coating composition, the intercoat adhesion between the second coating composition and the clear coating composition becomes insufficient.

DISCLOSURE OF THE INVENTION

An object of the present invention is to provide a novel method of forming a multilayered topcoat film free from the above drawback of the prior art.

Another object of the present invention is to provide a novel method of forming a multilayered topcoat film excellent in intercoat adhesion, finish properties such as film appearance and gloss, and film performance properties such as solvent resistance, weather resistance and water resistance.

Other objects and features of the present invention will be apparent from the following description.

The present invention provides a 3-coat 2-bake method of forming a multilayered topcoat film, comprising applying a first coating composition (A) and a second coating composition (B) to a substrate, thermally curing the two compositions, and applying and thermally curing a clear coating composition (C);

- the first coating composition (A) being an organic solvent-based colored coating composition;
- the second coating composition (B) being an organic solvent-based coating composition comprising an acrylic resin (b-1) whose main chain has, bonded thereto, at least two side chains of different lengths each having at least one hydroxyl group, a polyepoxide (b-2) and a crosslinking agent (b-3); and
- the clear coating composition (C) being a powder coating composition (C-1) or an organic solvent-based coating composition (C-2) comprising a hydroxyl- and carboxyl-containing resin (c-2*a*) and a polyepoxide (c-2*b*).

The present inventors conducted extensive research to develop a 3-coat 2-bake method of forming a multilayered topcoat film having improved intercoat adhesion between the second coating composition and the clear coating composition (which is a powder coating composition or an organic solvent-based coating composition to be cured by crosslinking between a carboxyl group and an epoxy group), without impairing finish properties and film performance of the multilayered topcoat film. As a result, they found that when the above specified organic solvent-based coating composition is used as the second coating composition, the intercoat adhesion between the second coating composition and the clear coating composition can be improved, without impairing the excellent finish properties and high film performance of the multilayered topcoat film and without necessitating sanding of the coating surface of the second coating composition.

The present invention has been accomplished based on these findings.

The method of forming a multilayered topcoat film of the present invention will be described below in further detail.

Substrate

Substrates usable in the method of the invention include metallic or plastic materials for automobiles, electric appliances, etc.; these materials as coated with an undercoat such as a cationic electrodeposition coat; and these materials as coated with the undercoat and an intermediate coat.

First Coating Composition (A)

In the method of the invention, the first coating composition (A) to be applied to the substrate is an organic solvent-based colored coating composition.

Usable as the composition (A) are known thermosetting coating compositions comprising a base resin, a crosslinking agent, a coloring pigment and an organic solvent.

Examples of base resins include acrylic resins, vinyl resins, polyester resins, alkyl resins and urethane resins, each having hydroxyl, epoxy, carboxyl, alkoxysilane or like crosslinkable functional group. These base resins may be used either singly or in combination.

Examples of crosslinking agents include alkyl-etherified melamine resins, urea resins, guanamine resins, polyisocyanate compounds, blocked polyisocyanate compounds, epoxy compounds and carboxyl-containing compounds. These crosslinking agents may be used either singly or in combination.

The proportions of the base resin and the crosslinking agent are usually about 50 to 90 wt. % of the base resin and about 50 to 10 wt. % of the crosslinking agent, based on the total amount of the two components.

Usable coloring pigments include titanium oxide, zinc oxide, carbon black, cadmium red, molybdenum red, chrome yellow, chrome oxide, Prussian blue, cobalt blue and like inorganic solid coloring pigments; azo pigments, phthalocyanine pigments, quinacridone pigments, isoindorine pigments, vat pigments, perylene pigments and like organic solid coloring pigments; flaky aluminum and like metallic pigments; and mica, metal oxide-coated mica, micaceous iron oxide and like light-interference coloring pigments. These pigments may be used either singly or in combination.

These coloring pigments are suitably selected to obtain a solid color coating composition, a metallic coating composition, a light-interference color coating composition or a coating composition having a combination of color characteristics of these coating compositions. The amount of the coloring pigment to be added can be determined in consideration of the hiding power described hereinafter.

Usable organic solvents include ordinary solvents for use in coating compositions, such as hexane, heptane, xylene, toluene, cyclohexane and like hydrocarbon solvents; methyl acetate, ethyl acetate, ethylene glycol monomethyl ether acetate, diethylene glycol monomethyl ether acetate and like ester solvents; isopropyl ether, ethylene glycol monomethyl ether, diethylene glycol monobutyl ether and like ether solvents; ethyl alcohol, butyl alcohol, hexyl alcohol and like alcohol solvents; and methyl isobutyl ketone, methyl ethyl ketone, isophorone, acetophenone and like ketone solvents.

The first coating composition (A) may further contain, where necessary, an extender pigment, a UV absorber, a photostabilizer, a flow modifier, an anti-cissing agent or like ordinary coating additive.

It is preferable that the composition (A) has a solid content of about 20 to 70 wt. %, preferably about 30 to 70 wt. %, at the time of application. The viscosity of the composition (A) is adjusted preferably to about 10 to 60 second (Ford Cup #4/20° C.) for application.

The single-layer coating of the composition (A) preferably has a hiding power sufficient to mask the color of the coating surface below the coating. Specifically stated, the composition (A) has such a hiding power that a 15 $\mu$m thick cured coating of the composition (A) has a light transmittance of 3% or less in the wavelength range of 400 to 700 nm.

The composition (A) can be applied by airless spraying, air spraying, electrostatic coating or like coating technique, to such a thickness as to form a cured coating of about 10 to 50 $\mu$m. The applied composition is allowed to stand, where necessary, for several minutes at room temperature to about 100° C., and then the second coating composition (B) described below is applied to the uncured coating surface of the composition (A).

Coating Composition (B)

In the method of the invention, the second coating composition (B) to be applied to the uncured coating surface of the first coating composition (A) is an organic solvent-based thermosetting coating composition comprising an acrylic resin (b-1) whose main chain has, bonded thereto, at least two side chains of different lengths each having at least one hydroxyl group, and a polyepoxide (b-2) and a crosslinking agent (b-3).

It is preferable that the composition (B) forms a colorless clear coating or a clear coating colored in such an extent that the color of the coating of the composition (A) can be seen through the coating of the composition (B). Stated specifically, the composition (B) preferably has such a transparency that a 15 $\mu$m thick cured coating of the composition (B) has a light transmittance of about 30 to 100% in the wavelength range of 400 to 700 nm. Because of the transparency of the composition (B), the multilayered topcoat film formed by the method of the invention has an appearance of depth and excellent decorative properties.

The acrylic resin (b-1) is made of a polymer chain containing an acrylic polymerizable monomer as an essential constituent, the polymer chain comprising a main chain and at least two side chains each having at least one hydroxyl group. The at least two side chains are different in length from each other, and bonded in a pendant-like fashion to the main chain. The hydroxyl group of each side chain is linked to the main chain of the acrylic resin via an atomic chain comprising carbon atom(s), oxygen atom(s), nitrogen atom(s) or other atom(s). Specifically, the atomic chain may be, for example, a divalent hydrocarbon group, or a divalent hydrocarbon group containing an ester bond, an ether bond, an amide bond or like bond. The length of the side chain means the number of atoms of the atomic chain linking the hydroxyl group to the main chain. It is essential for the acrylic resin (b-1) to have at least two side chains of different lengths.

Of the at least two side chains each bonded to the main chain of the acrylic resin (b-1) and having at least one hydroxyl group, a side chain having a longer atomic chain between the hydroxyl group and the main chain (hereinafter sometimes referred to as "longer side chain-hydroxyl") is different in length from a side chain having a shorter atomic chain between the hydroxyl group and the main chain (hereinafter sometimes referred to as "shorter side chain-hydroxyl") by at least 1, preferably at least 2, more preferably 2 to 20, in terms of the number of atoms constituting the side chains.

The acrylic resin (b-1) is obtainable by, for example, copolymerizing hydroxyl-containing polymerizable monomers and an acrylic polymerizable monomer as essential components and, where necessary, another polymerizable monomer.

Hydroxyl-containing polymerizable monomers are compounds each having at least one hydroxyl group and at least one polymerizable unsaturated bond per molecule, such as hydroxyethyl (meth)acrylate, hydroxypropyl (meth) acrylate, hydroxybutyl (meth)acrylate and like $C_2$ to $C_8$ hydroxyalkyl esters of (meth)acrylic acids; monoester of (meth)acrylic acids and polyether glycols such as polyethylene glycol, polypropylene glycol and polybutylene glycol; monethers of the above hydroxyalkyl esters and polyether glycols such as polyethylene glycol, polypropylene glycol and polybutylene glycol; adducts of $\alpha$, $\beta$-unsaturated carboxylic acids and monoepoxy compounds such as Cardula E-10 (tradename, a product of Shell Chemical Co.) and $\alpha$-olefin epoxides; adducts of glycidyl (meth)acrylates and monobasic acids such as acetic acid, propionic acid and p-t-butylbenzoic acid; lactone-modified acrylic monomers obtainable by reacting one of the above hydroxyalkyl esters with 1 to 5 moles of a lactone such as $\epsilon$-caprolactone, $\beta$-methyl-$\delta$-valerolactone, $\gamma$-valerolactone, $\delta$-valerolactone, $\delta$-caprolactone, $\gamma$-caprolactone, $\beta$-propiolactone or $\gamma$-butyrolactone; and N-methylol (meth)acrylamide and like amide monomers.

Commercial products of the lactone-modified acrylic monomers include, for example, Placcel FA-1, Placcel FA-2 and Placcel FA-3 (monomers prepared by addition reaction of hydroxyethyl acrylate and $\epsilon$-caprolactone), Placcel FM-1, Placcel FM-3 and Placcel FM-5 (monomers respectively prepared by addition reaction of 1 mole of hydroxyethyl methacylate and 1, 3 or 5 moles of $\epsilon$-caprolactone), all available from Daicel Chemical Industries Co., Ltd.; and TONEm-100 (a monomer prepared by addition reaction of 1 mole of hydroxyethyl acrylate and 2 moles of $\epsilon$-caprolactone).

The hydroxyl-containing acrylic resin for use in the invention can be obtained also by reacting a hydroxyl-containing acrylic resin and any of the above lactones.

An acrylic resin having a longer side chain-hydroxyl and a shorter side chain-hydroxyl can be obtained by using, as hydroxyl-containing polymerizable monomers, at least two monomers different from each other in the length of the atomic chain intervening between the hydroxyl group and the polymerizable unsaturated bond.

Examples of acrylic polymerizable monomers include monoesters of (meth)acrylic acids and $C_1$ to $C_{24}$ monovalent aliphatic or alicyclic alcohols, such as methyl (meth) acrylate, ethyl (meth)acrylate, propyl (meth)acrylate, butyl (meth)acrylate, hexyl (meth)acrylate, 2-ethylhexyl (meth) acrylate, octyl (meth)acrylate, decyl (meth)acrylate, lauryl (meth)acrylate and cyclohexyl (meth)acrylate.

The other polymerizable monomer is a polymerizable unsaturated group-containing compound other than the above hydroxyl-containing polymerizable monomers and acrylic polymerizable monomers. Usable as the other monomer are, for example, the following:

i) carboxyl-containing polymerizable monomers such as acrylic acid, methacrylic acid, crotonic acid, itaconic acid, maleic acid and fumaric acid;

ii) polymerizable amide monomers such as N-methoxymethyl (meth)acrylamide and N-butoxymethyl (meth)acrylamide;

iii) vinyl ethers such as ethyl vinyl ether, propyl vinyl ether, butyl vinyl ether, hexyl vinyl ether, cyclopentyl vinyl ether, cyclohexyl vinyl ether, phenyl vinyl ether, benzyl vinyl ether and allyl glycidyl ether;

iv) vinyl acetate, vinyl propionate, ethylene, propylene, vinyl chloride, styrene, α-methylstyrene, N,N-dimethylaminoethyl (meth)acrylate, N,N-diethylaminoethyl (meth)acrylate, (meth)acrylamide, (meth)acrylonitrile, vinyl pyrrolidone and the like;

v) epoxy-containing polymerizable monomers such as glycidyl (meth)acrylate, methyl glycidyl (meth) acrylate, allyl glycidyl ether and 3,4-epoxycyclohexyl methyl (meth)acrylate.

The acrylic resin (b-1) can be prepared by carrying out, in an ordinary manner, solution polymerization of the hydroxyl-containing polymerizable monomers and acrylic polymerizable monomer as essential components and, where necessary the other polymerizable monomer, using, for example, a radical polymerization catalyst.

The proportions of these monomers can be selected so that the resulting acrylic resin has a hydroxyl value of 50 to 200 mg KOH/g, preferably 70 to 150 mg KOH/g. It is desirable that the acrylic resin has a number average molecular weight of 3,000 to 50,000, in particular 5,000 to 20,000. The hydroxyl value specified above is the total of the hydroxyl value of the longer side chain-hydroxyl and the hydroxyl value of the shorter side chain-hydroxyl. It is preferable that the proportions of the hydroxyl value of the longer side chain-hydroxyl and the hydroxyl value of the shorter side chain-hydroxyl are 10 to 90%, in particular 30 to 50%, of the former, and 90 to 10%, in particular 70 to 50%, of the latter.

The polyepoxide (b-2) is a compound having an average of at least 2 epoxy groups per molecule. The polyepoxide preferably has a number average molecular weight of about 120 to 200,000, in particular about 240 to 80,000. Polyepoxides having a number average molecular weight less than about 120 are difficult to obtain, while those having a number average molecular weight more than about 200,000 are difficult to handle because of their increased viscosity, and result in a coating poor in solvent resistance, scratch resistance and other properties owing to their large molecular weight between crosslinks.

Specific examples of polyepoxides usable as the polyepoxide (b-2) include polymers obtainable by radical polymerization of an epoxy-containing ethylenically unsaturated monomer [e.g., glycidyl (meth)acrylate, methyl glycidyl (meth)acrylate, allyl glycidyl ether or like glycidyl-containing ethylenically unsaturated monomer, 3,4-epoxycyclohexylmethyl (meth)acrylate or like alicyclic epoxy-containing ethylenically unsaturated monomer] and, where necessary, another vinyl monomer such as a hydroxyl-containing ethylenically unsaturated monomer (e.g., the above hydroxyl-containing acrylic monomers), any of the above $C_1$ to $C_{24}$ alkyl (meth)acrylates, cycloalkyl (meth)acrylate or an aromatic vinyl monomer; glycidyl ether compounds such as diglycidyl ether, 2-glycidyl phenyl glycidyl ether and 2,6-diglycidyl phenyl glycidyl ether; glycidyl- and alicyclic epoxy-containing compounds such as vinylcyclohexene dioxide and limonene dioxide; and alicyclic epoxy-containing compounds such as dicyclopentadiene dioxide, bis(2,3-epoxycyclopentyl)ether, epoxycyclohexene carboxylic acid ethylene glycol diester, bis(3,4-epoxycyclohexylmethyl)adipate, 3,4-epoxycyclohexylmethyl-3,4-epoxycyclohexane carboxylate, and 3,4-epoxy-6-methylcyclohexylmethyl-3,4-epoxy-6-methylcyclohexane carboxylate. Of these examples, preferred are polymers containing, as monomer components, an epoxy-containing ethylenically unsaturated monomer and optionally a hydroxyl-containing ethylenically unsaturated monomer, since these polymers have good low-temperature curability.

Usable as the crosslinking agent (b-3) are, for example, alkyl-etherified melamine resins, urea resins, guanamine resins, polyisocyanate compounds and blocked polyisocyanate compounds.

The second coating composition (B) is an organic solvent-based coating composition comprising an acrylic resin (b-1), a polyepoxide (b-2) and a crosslinking agent (b-3). Usable organic solvents include those shown hereinabove for use in the composition (A).

The proportions of the above components of the composition (B) are not limited and may be varied according to the kinds of the components or other factors. It is usually suitable to use, relative to 100 parts by weight of the acrylic resin (b-1), about 5 to 150 parts by weight of the polyepoxide (b-2) and about 5 to 150 parts by weight of the crosslinking agent (b-3).

From the viewpoint of improvement in scratch resistance of the multilayered film, it is preferable that the composition (B) contains an alkoxysilane-containing acrylic resin, in addition to the acrylic resin (b-1), the polyepoxide (b-2) and the crosslinking agent (b-3).

The alkoxysilane-containing acrylic resin is obtainable by copolymerizing an alkoxysilane-containing polymerizable monomer and an acrylic polymerizable monomer as essential components and, where necessary, a hydroxyl-containing polymerizable monomer and/or another polymerizable monomer.

The alkoxysilane-containing polymerizable monomer is a compound having at least one alkoxysilane group and at least one polymerizable unsaturated bond per molecule. Examples of such compounds include vinyl trimethoxysilane, vinyl methyl dimethoxysilane, vinyl triethoxysilane, vinyl methyl diethoxysilane, vinyl tris(2-methoxyethoxy)silane, γ-(meth)acryloyloxypropyltrimethoxysilane, γ-(meth)acryloyloxypropylmethyldimethoxysilane, vinyl triacetoxysilane, β-(meth) acryloyloxyethyltrimethoxysilane, γ-(meth) acryloyloxypropyltriethoxysilane, and γ-(meth) acryloyloxypropylmethyldiethoxysilane.

The acrylic polymerizable monomer and hydroxyl-containing polymerizable monomer may be any of those shown as the monomers for forming the acrylic resin (b-1). Further, it is suitable to select the other polymerizable monomer from monomers shown as the other polymerizable monomer constituting the acrylic resin (b-1).

The composition (B) may further contain, where necessary, a curing catalyst, a coloring pigment, an extender pigment, a UV absorber, a photostabilizer, a flow modifier, an anti-cissing agent or like ordinary coating additive.

In particular, a coloring pigment may or may not be added to the composition (B) so as to obtain a coating composition for forming a colorless clear coating or a coating composition for forming a clear coating colored in such an extent that the color of the coating of the composition (A) can be seen through the coating of the composition(B). Any of the coloring pigments shown hereinbefore as pigments usable for the composition (A) can be employed for the composition (B). One or more coloring pigments may be selected to prepare a solid color coating composition, a metallic coating composition, a light-interference color coating composition or a coating composition having a combination of color characteristics of these coating compositions. The amount of the coloring pigment to be added can be determined in consideration of the above specified transparency of the coating of the composition (B).

Usable curing catalysts include, for example, dibutyltin dilaurate and like tin compounds, aluminum chelate compounds, titanium chelate compounds, zirconium chelate compounds, aluminum ester, tetramethyl titanate, tetrapentyl titanate and like titanates, and tetramethyl zirconate, tetrapentyl zirconate and like zirconates. The curing catalyst, when employed, is used preferably in a proportion of about 0.1 to 10 parts by weight relative to 100 parts by weight of the total amount of the acrylic resin (b-1), the polyepoxide (b-2) and the crosslinking agent (b-3).

It is suitable that the composition (B) has a solid content of about 20 to 70 wt. %, preferably about 30 to 70 wt. %, at the time of application. Further, the viscosity of the composition (B) is adjusted preferably to about 10 to 60 seconds (Ford cup #4/20° C.) for application.

The composition (B) is applied to the uncured coating surface of the composition (A) by airless spraying, air spraying, electrostatic coating or like coating technique, to such a thickness as to form a cured coating of about 10 to 50 μm. The two compositions are cured and crosslinked by heating at about 100 to 180° C., preferably about 120 to 160° C., for about 10 to 40 minutes. Then, the clear coating composition (C) described below is applied to the cured coating surface.

When the composition (B) is a coating composition that forms a colored clear coating having the specific transparency, the multilayer coating formed by applying the composition (B) to the colored coating surface of the composition (A) has improved decorative and aesthetic properties as compared with the single-layer coating of the composition (A), due to the combination of the colors of the two coatings, such as solid color, metallic color, light-interference color, etc.

Clear Coating Composition (C)

The clear coating composition (C) is a composition to be applied to the cured coating surface of the composition (B), for forming a clear coating. The composition (C) is a powder coating composition (C-1) or an organic solvent-based thermosetting coating composition (C-2) comprising a hydroxyl- and carboxyl-containing resin (c-2*a*) and a polyepoxide (c-2*b*).

The powder coating composition (C-1) comprises a base resin and a crosslinking agent as main components.

Usable base resins include, but are not limited to, acrylic resins, polyester resins, fluorocarbon resins and urethane resins, each having at least one crosslinkable functional group selected from among hydroxyl, carboxyl, glycidyl and like group; and graft polymers or like modification products of these resins. Particularly preferred base resins include glycidyl-containing acrylic resins.

It is generally preferable that the base resin has a glass transition temperature of about 50° C. or higher, in particular 60 to 120° C. The molecular weight of the base resin is not limited and can be suitably selected according to the purpose.

The crosslinking agent is used to three-dimensionally crosslink and cure the base resin when heated. Examples of crosslinking agents include alkyl-etherified melamine resins, blocked polyisocyanate compounds, epoxy compounds, isocyanurate compounds and aliphatic dibasic acids, among which aliphatic dibasic acids are particularly preferred.

The base resin and the crosslinking agent are used, most preferably, in such proportions that the molar ratio of the functional group in the base resin to the functional group in the crosslinking agent is about 1:1.

The powder coating composition (C-1) may further contain, where necessary, a flow modifier, a UV absorber, a photostabilizer or like coating additive.

The powder coating composition (C-1) can be prepared by melting and kneading the above components and cooling the melt, followed by grinding to a suitable particle size.

The composition (C-1) may be applied by any powder coating technique, such as electrostatic spraying or fluidized-dipping, without limitation.

The thickness of the coating of the powder coating composition is not limited, but a thickness of 20 to 200 μm (when cured) is usually suitable. A thickness of 20 to 120 μm is particularly preferred to obtain a coating that is good in smoothness, image sharpness, gloss and apparent thickness. The powder coating composition is cured usually at, for example, about 120 to 180° C.

The organic solvent-based coating composition (C-2) is a thermosetting coating composition comprising a hydroxyl- and carboxyl-containing resin (c-2*a*), a polyepoxide (c-2*b*) and an organic solvent as essential components.

The resin (c-2a) contains carboxyl groups in an amount of about 15 to 150 mg KOH/g, preferably about 20 to 100 mg KOH/g, calculated as an acid value. If the acid value is less than about 15 mg KOH/g, the low-temperature curability and other properties are impaired, whereas if the acid value is more than about 150 mg KOH/g, the resulting coating will be poor in water resistance, weather resistance, etc. Thus, acid values outside the specified range are undesirable.

The resin (c-2*a*) contains hydroxyl groups in an amount of about 20 to 300 mg KOH/g, preferably about 20 to 200 mg KOH/g, calculated as a hydroxyl value. If the hydroxyl value is less than about 20 mg KOH/g, the low-temperature curability, durability and other properties of the coating will be impaired, whereas if the hydroxyl value is more than about 300 mg KOH/g, the water resistance and other properties of the resulting coating will be impaired because of a large amount of unreacted hydroxyl groups remaining in the coating. Thus, hydroxyl values outside the specified range are undesirable.

It is preferable that the resin (c-2*a*) has a number average molecular weight of about 3,000 to 200,000, in particular about 5,000 to 80,000. If the number average molecular weight is less than about 3,000, the resulting coating will have lowered durability, whereas if the number average molecular weight is more than about 200,000, the resin is difficult to handle because of an increased viscosity. Thus, number average molecular weights outside the specified range are undesirable.

The resin (c-2*a*) is not limited in kind and may be suitably selected from known resins. Preferred are, for example, acrylic resins, fluorocarbon resins and polyester resins, from the viewpoints of weather resistance, durability and other properties of the coating.

Specific examples of acrylic resins include those prepared by copolymerizing a hydroxy-containing acrylic monomer and a carboxyl-containing ethylenically unsaturated monomer as essential monomer components, and where necessary, another ethylenically unsaturated monomer. Examples of hydroxyl-containing acrylic monomers include hydroxyethyl (meth)acrylate, hydroxypropyl (meth) acrylate, hydroxybutyl (meth)acrylate, (poly)ethylene glycol mono(meth)acrylate, (poly)propylene glycol mono (meth)acrylate, and adducts of these monomers and caprolactones such as ϵ-caprolactone. Examples of carboxyl-containing ethylenically unsaturated monomers include (meth)acrylic acid, maleic acid and maleic anhydride. Examples of other ethylenically unsaturated monomers include methyl (meth)acrylate, ethyl (meth)acrylate, propyl (meth)acrylate, butyl (meth)acrylate, octyl (meth) acrylate, 2-ethylhexyl (meth)acrylate, stearyl (meth) acrylate, cyclohexyl (meth)acrylate and like $C_1$ to $C_{24}$ alkyl (meth)acrylates or cycloalkyl (meth)acrylates; styrene, vinyl toluene and like aromatic vinyl monomers; (meth) acrylonitrile and like nitrile compounds; and (meth) acrylamide, N-methylol (meth)acrylamide and like amide compounds.

Specific examples of acrylic resins other than those mentioned above include a half-esterified product of a hydroxyl-containing acrylic resin obtainable by copolymerizing any of the above hydroxyl-containing acrylic monomers and, where necessary, another ethylenically unsaturated monomer, the half-esterified product being produced by reacting part of hydroxyl groups of the acrylic resin with a polybasic anhydride. Usable polybasic anhydrides include maleic anhydride, itaconic anhydride, succinic anhydride, HET anhydride, himic anhydride, phthalic anhydride, 1,2-cyclohexanedicarboxylic anhydride, hexahydrophthalic anhydride, trimellitic anhydride and pyromellitic anhydride.

Specific examples of fluorocarbon resins include resins having a fluorine group in their side chain and resins having a carboxyl group introduced thereto. The fluorocarbon resins having a fluorine group in their side chain are obtainable by, for example, copolymerizing any of the above hydroxyl-containing acrylic monomers, any of the above carboxyl-containing ethylenically unsaturated monomers, and a meth (acrylate) monomer containing a perfluoroalkyl or perfluoroalkenyl group [e.g., perfluorobutylethyl (meth) acrylate, perfluorooctylethyl (meth)acrylate, perfluoroisononylethyl (meth)acrylate or perflurodecylethyl (meth) acrylate and, where necessary, any of the other ethylenically unsaturated monomers mentioned above. The resins having a carboxyl group introduced thereto can be prepared by, for example, reacting any of the above polybasic anhydrides with part of hydroxyl groups of a hydroxyl-containing resin obtainable by copolymerizing a hydroxyl-containing vinyl monomer (e.g., hydroxyethyl vinyl ether, hydroxypropyl vinyl ether, hydroxybutyl vinyl ether or (poly)ethylene glycol monoallyl ether), a fluoroolefin (e.g., vinyl fluoride, vinylidene fluoride, ethylene trifluoride chloride or ethylene tetrafluoride) and, where necessary, another ethyleneically unsaturated monomer (e.g., ethylene, propylene, butylene, ethyl vinyl ether, butyl vinyl ether, cyclohexyl vinyl ether, vinyl acetate, vinyl butylate or vinyl propionate). The hydroxyl-containing resin for use in preparation of the resins having a carboxyl group introduced thereto may be one prepared using, as an essential monomer component, a carboxyl-containing ethylenically unsaturated monomer such as (meth)acrylic acid, maleic acid, fumaric acid, itaconic acid or citraconic acid.

The polyester resins mentioned above are chiefly esters of polybasic acids and polyhydric alcohols.

A mainly used polybasic acid is at least one dibasic acid selected from among phthalic anhydride, isophthalic acid, terephthalic acid, succinic acid, adipic acid, fumaric acid, maleic anhydride, tetrahydrophthalic anhydride, hexahydrophthalic anhydride and the like. Also usable where necessary are benzoic acid, crotonic acid, p-tert-butylbenzoic acid or like monobasic acid, trimellitic anhydride, methylcyclohexene tricarboxylic acid, pyromellitic anhydride and like tri- or higher polybasic acid, and so on.

A mainly used polyhydric alcohol is, for example, ethylene glycol, propylene glycol, diethylene glycol, butanediol, neopentyl glycol, cyclohexane dimethanol, 1,6-hexanediol or like dihydric alcohol. Where necessary, the dihydric alcohol is used in combination with glycerine, trimethylolethane, trimethylolpropane, pentaerythritol or like tri- or higher polyhydric alcohol.

The polyepoxide (c-2*b*) in the organic solvent-based coating composition (C-2) for use in the present invention is a compound having an average of at least about 2 epoxy groups per molecule. The polyepoxide (c-2*b*) serves as a crosslinking agent for the resin (c-2*a*).

The polyepoxide (c-2*b*) may be the same as the polyepoxide (b-2) in the second coating composition (B), and any of polyepoxides shown as the polyepoxide (b-2) can be employed as the polyepoxide (c-2*b*).

In the organic solvent-based thermosetting coating composition (C-2), the hydroxyl- and carboxyl-containing resin (c-2*a*) and the polyepoxide (c-2*b*) are used, based on the total amount of the two components, in the following proportions:

The resin (C-2*a*) is used in a proportion of about 5 to 95 wt. %, preferably about 15 to 85 wt. %. If the proportion is less than about 5 wt. %, the base resin content of the composition will be too small, thus resulting in a coating poor in finished appearance and performance. On the other hand, if the proportion is more than about 95 wt. %, the curability of the composition will be impaired. Thus, proportions outside the specified range are undesirable.

The polyepoxide (C-2*b*) is used in a proportion of about 5 to 95 wt. %, preferably about 15 to 85 wt. %. If the proportion of the polyepoxide (C-2*b*) is outside the specified range, the curability of the composition will reduce, hence undesirable.

The organic solvent in the coating composition (C-2) is a component for dissolving or dispersing the components (c-2*a*) and (c-2*b*). The organic solvent is not limited as long as it is capable of dissolving or dispersing the components (c-2*a*) and (c-2*b*), and can be suitably selected from known organic solvents, including those usable for the first coating composition (A).

The organic solvent is added in such an amount that the coating composition (C-2) has a solid content of about 10 to 70 wt. %. It is suitable that the viscosity of the coating composition (C-2) at the time of application is adjusted to about 10 to 60 seconds (Ford Cup #4/20° C.).

The coating composition (C-2) may contain, where necessary, a curing catalyst, an extender pigment, a UV absorber, a UV stabilizer, a flow modifier or like coating additive, in addition to the hydroxyl- and carboxyl-containing resin (c-2*a*), the polyepoxide (c-2*b*) and the organic solvent.

The coating technique for applying the organic solvent-based thermosetting coating composition (C-2) is not limited, and may be air spraying, airless spraying, electrostatic air spraying, electrostatic airless spraying, rotary atomization or like technique.

Coating Procedure

The method of forming a multilayered topcoat film of the present invention is a 3-coat 2-bake coating method comprising applying to a substrate the first coating composition (A) and second coating composition (B) described above, thermally curing the two compositions, and applying and thermally curing the clear coating composition (C).

More specifically, the coating procedure is as follows: The first coating composition (A) of a solid, metallic or light-interference color is applied to a substrate by airless spraying, air spraying, electrostatic coating or like coating technique, to such a thickness as to form a cured coating having a thickness of about 10 to 50 μm, and where necessary, the coated substrate is allowed to stand for several minutes at room temperature. Then, the second coating composition (B) is applied.

The second coating composition (B) may be a composition containing no coloring pigment, or a composition containing a coloring pigment in such an amount that the composition (B) forms a clear coating of a solid, metallic or light-interference color, through which the color of the coating of the composition (A) can be seen through the coating of the composition (B). The composition (B) is applied to the uncured coating surface of the composition (A) by airless spraying, air spraying, electrostatic coating or like technique, to such a thickness as to form a cured coating having a thickness of about 10 to 50 μm. Where necessary, after being allowed to stand at room temperature, the compositions (A) and (B) are at the same time cured and crosslinked by heating at about 100 to 180° C., preferably about 120 to 160° C., for about 10 to 40 minutes.

Subsequently, the clear coating composition (C) is applied to the cured coating surface of the composition (B), by airless spraying, air spraying, electrostatic coating or like technique, to such a thickness as to form a cured coating having a thickness of about 20 to 200 μm, and cured and crosslinked by heating at about 100 to 180° C., preferably about 120 to 160° C., for about 10 to 40 minutes, thereby giving a multilayered topcoat film.

It is preferable that the viscosity of each of the first coating composition (A), the second coating composition (B) and the clear coating composition (C) at the time of application is adjusted to about 10 to 60 seconds (Ford Cup #4/20° C.).

The present invention provides a 3-coat 2-bake method of forming a multilayered topcoat film, comprising applying a first coating composition and a second coating composition to a substrate, thermally curing the two compositions, applying as a clear coating composition, a powder coating composition or an organic solvent-based coating composition to be cured by crosslinking of a carboxyl group and an epoxy group, and thermally curing the clear coating composition; in which method the second coating composition and the clear coating composition have remarkably improved intercoat adhesion. Further, the obtained multilayered topcoat film is excellent in finish properties such as appearance and gloss, and performance properties such as solvent resistance, weather resistance and water resistance.

Accordingly, the method of the present invention is extremely useful as a method for forming a topcoat film on an automobile body or the like.

BEST MODE FOR CARRYING OUT THE INVENTION

The following Production Examples, Examples and Comparative Examples are provided to illustrate the present invention in further detail. In these examples, parts and percentages are all by weight.

PRODUCTION EXAMPLE 1

Production of First Coating Composition (A)

A coating composition (A-1) was obtained by mixing together 65 parts (as solids, the same applies hereinafter) of a polyester resin (hydroxyl value: 150 mg KOH/g, acid value: 5 mg KOH/g, number average molecular weight: 3,000), 35 parts of a melamine resin (tradename "U-Van 28-60", a product of Mitsui Totatsu Chemicals, Inc.) and 10 parts of carbon black, followed by dilution with xylene to a viscosity of 14 seconds (Ford Cup #4/20° C.). The composition (A-1) had such a hiding power that a 15 μm thick cured coating of the composition (A-1) had a light transmittance of 0.1% or less in the light wavelength range of 400 to 700 nm.

PRODUCTION EXAMPLE 2

Production of Hydroxyl-containing Acrylic Resin (b-1*a*)

A hydroxyl-containing acrylic resin (b-1a) was obtained by copolymerizing in an ordinary manner 37 parts of Placcel FA-2 (tradename, a product of Daicel Chemical Industries Co., Ltd., a monomer prepared by addition reaction of hydroxyethyl acrylate and E-caprolactone), 23 parts of hydroxybutyl acrylate, 2 parts of acrylic acid, 18 parts of n-butyl acrylate and 20 parts of styrene. The resin (b-1a) had a hydroxyl value of 150 mg KOH/g, an acid value of 15 mg KOH/g and a number average molecular weight of 10,000. Of the hydroxyl value, 40% was attributable to Placcel FA-2, and 60% to hydroxybutyl acrylate. In the resin (b-1*a*), the difference in length between the longer side chain-hydroxyl and the shorter side chain-hydroxyl was 12 atoms.

PRODUCTION EXAMPLE 3

Production of Hydroxyl-containing Acrylic Resin (b-1*b*)

A hydroxyl-containing arylic resin (b-1b) was obtained by copolymerizing 12.5 parts of hydroxyethyl acrylate, 23 parts of hydroxybutyl acrylate, 2 parts of acrylic acid, 42.5 parts of n-butyl acrylate and 20 parts of styrene. The resin (b-1*b*) had a hydroxyl value of 150 mg KOH/g, an acid value of 15 mg KOH/g and a number average molecular weight of 10,000. Of the hydroxyl value, 40% was attributable to hydroxyethyl acrylate, and 60% to hydroxybutyl acrylate. In the resin (b-1*b*), the difference in length between the longer chain-hydroxyl and the shorter side chain-hydroxyl was 2 atoms.

PRODUCTION EXAMPLE 4

Production of Comparative Hydroxyl-containing Acrylic Resin (b-1*c*)

A hydroxyl-containing acrylic resin (b-1*c*) was obtained by copolymerizing in an ordinary manner 12.5 parts of hydroxyethyl acrylate, 21 parts of hydroxyethyl methacrylate, 2 parts of acrylic acid, 44.5 parts of n-butyl acrylate and 20 parts of styrene. The resin (b-1*c*) had a hydroxyl value of 150 mg KOH/g, an acid value of 15 mg KOH/g and a number average molecular weight of 10,000. Of the hydroxyl value, 40% was attributable to hydroxyethyl acrylate, and 60% to hydroxyethyl methacrylate. In the resin (b-1*c*), the difference in side chain length between the longer side chain-hydroxyl and the shorter side chain-hydroxyl is 0.

PRODUCTION EXAMPLE 5

Production of Comparative Hydroxyl-containing Acrylic Resin (b-1*d*)

A hydroxyl-containing acrylic resin (b-1*d*) was obtained by copolymerizing in an ordinary manner 31 parts of hydroxyethyl acrylate, 2 parts of acrylic acid, 47 parts of n-butyl acrylate and 20 parts of styrene. The resin (b-1*d*) had a hydroxyl value of 150 mg KOH/g, an acid value of 15 mg KOH/g and a number average molecular weight of 10,000.

PRODUCTION EXAMPLE 6

Production of Polyepoxide (b-2*a*)

A polyepoxide (b-2*a*), i.e., a glycidyl- and hydroxyl-containing acrylic resin, was obtained by copolymerizing in an ordinary manner 40 parts of glycidyl methacrylate, 21 parts of hydroxyethyl acrylate and 39 parts of n-butyl acrylate. The resin (b-2*a*) had an epoxy equivalent of 355, a hydroxyl value of 100 mg KOH/g and a number average molecular weight of 10,000.

PRODUCTION EXAMPLE 7

Production of polyepoxide (b-2*b*)

The polyepoxide (b-2*b*) was a 3,4-epoxycyclohexylmethyl-3,4-cyclohexane carboxylate (tradename "ERL-4221", a product of Union Carbide Corp.) having an epoxy equivalent of 138, an acid value of 0 mg KOH/g and a number average molecular weight of 276.

PRODUCTION EXAMPLE 8

Production of Second Coating Composition (B)

Second coating compositions (B)-(1) to (B)-(7) were obtained by mixing the components shown in Table 1 in the proportions (as solids) shown in the table, followed by dilution with "Swasol 1000" (tradename, a hydrocarbon solvent manufactured by Cosmo Oil Co., Ltd.) to a viscosity of 20 second (Ford Cup #4/20° C.). Table 1 shows the light transmittance (%) of 15 μm thick cured coatings of the second coating compositions (B)-(1) to (B)-(7) in the wavelength range of 400 to 700 nm.

The compositions (B)-(1) to (B)-(4) are second coating compositions according to the present invention, whereas the compositions (B)-(5) to (B)-(7) are for comparison.

"NM-20SE" and "BL-3175" shown in Table 1 are the following crosslinking agents:

NM-20SE: a n-butylated melamine resin manufactured by Mitsui Chemical Co., having a solid content of 60%

BL-3175: a hexamethylene diisocyanurate-based blocked isocyanate manufactured by Sumitomo Bayer Urethane Co., Ltd., having a solid content of 75%

PRODUCTION EXAMPLE 9

Production of Powder Clear Coating (C)

A flask was charged with 40 parts of methyl methacrylate, 30 parts of 2-ethylhexyl acrylate, 30 parts of glycidyl methacrylate, 10 parts of styrene, 1 part of t-butyl peroxide and 2 parts of oleic acid potash soap (surfactant). The mixture in the flask was thermally polymerized by a suspension polymerization method and dried, giving a glycidyl-containing acrylic resin. The resin had a glass transition temperature of about 60° C.

100 parts of the acrylic resin, 25 parts of decamethylene dicarboxylic acid and 1 part of a surface modifier were melted and kneaded in a heating kneader, at 120° C. for 10 minutes. The knead was then cooled and grained using a grinder to thereby obtain a powder clear coating composition (C-1) having a particle size of about to 150 μm.

PRODUCTION EXAMPLE 10

Production of Organic Solvent-based Clear Coating Composition (C)

232 g of 2-hydroxyethyl acrylate, 72 g of acrylic acid, 546 g of n-butyl methacrylate, 150 g of styrene and 20 g of azobisisobutyronitrile were polymerized in 1,000 g of xylene, giving a solution of a hydroxyl- and carboxyl-

TABLE 1

| Second coating composition (B) | (1) | (2) | (3) | (4) | (5) | (6) | (7) |
|---|---|---|---|---|---|---|---|
| Hydroxyl-containing acrylic resin | | | | | | | |
| b-1a | 100 | | 100 | 100 | | | 100 |
| b-1b | | 100 | | | | | |
| b-1c | | | | | 100 | | |
| b-1d | | | | | | 100 | |
| Polyepoxide | | | | | | | |
| b-2a | 75 | 75 | | 75 | 75 | 75 | |
| b-2b | | | 75 | | | | |
| Crosslinking agent | | | | | | | |
| NM-20SE | 75 | 75 | 75 | | 75 | 75 | 43 |
| BL-3175 | | | | 75 | | | |
| Catalyst | | | | | | | |
| Dibutyltin dilaurate | | | | 2.5 | | | |
| Coloring pigment | | | | | | | |
| Phthalocyanine blue | 2.5 | 2.5 | 2.5 | 2.5 | 2.5 | 2.5 | 1.4 |
| Flaky aluminum | 0.5 | 0.5 | 0.5 | 0.5 | 0.5 | 0.5 | 0.3 |
| Light transmittance (%) | 45 | 45 | 45 | 45 | 45 | 45 | 45 |

containing acrylic resin (c-2*a*), having a resin solid content of 50%. The resin (c-2*a*) had a number average molecular weight of 20,000, a hydroxyl value of 112 mg KOH/g and an acid value of 56 mg KOH/g.

Separately, 392 g of 3,4-epoxycyclohexylmethyl methacrylate, 608 g of 2-ethylhexyl methacrylate and 20 g of azobisisobutyronitrile were polymerized in 1,000 g of xylene, giving a solution of an epoxy-containing acrylic resin (c-2*b*), having a resin solid content of 50%. The resin (c-2*b*) had a number average molecular weight of 20,000 and contained an average of 40 epoxy groups per molecule.

67 parts (as solids) of the resin (c-2*a*) and 33 parts (as solids) of the resin (C-2*b*) were mixed together, and the mixture was diluted with "Swasol 1000" (tradename, a hydrocarbon solvent manufactured by Cosmo Oil Co., Ltd.) to a viscosity of 20 seconds (Ford Cup #4/20° C.), to thereby obtain an organic solvent-based thermosetting clear coating composition (C-2).

EXAMPLES 1 TO 8 AND COMPARATIVE EXAMPLES 1 TO 3

Substrate was prepared by applying, to metal plates (each 150×100×0.8 mm), an epoxy cationic electrodeposition coating composition (tradename "Elecron #9400", a product of Kansai Paint Co., Ltd.) and an intermediate coating composition (tradename "TP-37", an organic solvent-based polyester-melamine coating composition manufactured by Kansai Paint Co., Ltd.), followed by thermal curing. The first coating composition (A) was applied by air spraying to each substrate to a thickness of 20 μm (when cured), and allowed to stand at room temperature for about 3 minutes. Then, the second coating composition (B) was applied to the uncured coating surface of the composition (A) by air spraying to a thickness of 20 μm (when cured), and allowed to stand for about 3 minutes. The two compositions were cured by heating at 140° C. for 30 minutes. Subsequently, the clear coating composition (C-1) of Production Example 9 or the clear coating composition (C-2) of Production Example 10 was applied to the cured coating surface. When using the composition (C-1), the composition was applied by electrostatic spraying to a thickness of 40 μm (when cured), and when using the composition (C-2), the composition was applied by air spraying to a thickness of 40 μm (when cured). After being allowed to stand at room temperature for 3 minutes, the clear coating composition is thermally cured under the baking conditions shown in Table 2.

The coated plates obtained by the above procedure were tested by the following methods. Finished appearance: The coated plates were visually evaluated on the following scale. A: Good in gloss, smoothness and the like; B: Notably inferior in gloss, smoothness and the like; C: Extremely inferior in gloss, smoothness and the like.

Initial intercoat adhesion: On the multilayer topcoat film of each of the coated plates immediately after preparation, 11 cuts reaching the substrate were made at 2 mm intervals using a cutter knife. Then, 11 cuts perpendicular to the previously formed cuts were made in a similar manner at 2 mm intervals, so as to form 100 squares (2×2 mm). At 20° C., an adhesive cellophane tape was adhered to the cut surface and then rapidly peeled off. The number of squares that remained on each coated plate was counted to evaluate the initial intercoat adhesion on the following scale. A: No square peeled off, showing excellent adhesion; B: 1 to 10 squares peeled off, showing slightly inferior adhesion; C: 11 or more squares peeled off, showing inferior adhesion.

Intercoat adhesion after water dipping: The coated plates were dipped in water at 80° C. for 24 hours. Then, on the multilayer topcoat film of each coated plate, 11 cuts reaching the substrate were made at 2 mm intervals using a cutter knife. Subsequently, 11 cuts perpendicular to the previously formed cuts were made in a similar manner at 2 mm intervals, so as to form 100 squares (2×2 mm). At 20° C., an adhesive cellophane tape was adhered to the cut surface and then rapidly peeled off. The number of squares that remained on each coated plate was counted to evaluate the intercoat adhesion after water dipping on the following scale. A: No square peeled off, showing excellent adhesion; B: 1 to 10 squares peeled off, showing slightly inferior adhesion; C: 11 or more squares peeled off, showing inferior adhesion.

Table 2 shows the coating compositions used, conditions for baking the clear coating compositions, and results of the film performance test.

TABLE 2

| | Examples | | | | | | | | Comp. Ex. | | |
|---|---|---|---|---|---|---|---|---|---|---|---|
| | 1 | 2 | 3 | 4 | 5 | 6 | 7 | 8 | 1 | 2 | 3 |
| First coating composition (A) | A-1 | | | | A-1 | | | | A-1 | | |
| Second coating composition (B) | (1) | (2) | (3) | (4) | (1) | (2) | (3) | (4) | (5) | (6) | (7) |
| Clear coating composition (C) | C-1 | | | | C-2 | | | | C-2 | | |
| Conditions for baking the composition (C) | 170° C. 30 min | | | | 140° C. 30 min | | | | 140° C. 30 min | | |
| Film performance properties | | | | | | | | | | | |
| Finished appearance | A | A | A | A | A | A | A | A | A | A | A |
| Initial intercoat adhesion | A | A | A | A | A | A | A | A | A | A | A |
| Intercoat adhesion after water dipping | A | A | A | A | A | A | A | A | C | C | C |

What is claimed is:

1. A 3-coat 2-bake method of forming a multilayered topcoat film, comprising applying a first coating composition (A) and a second coating composition (B) to a substrate, thermally curing the two compositions, and applying and thermally curing a clear coating composition (C);

the first coating composition (A) being an organic solvent-based colored coating composition;

the second coating composition (B) being an organic solvent-based coating composition comprising an acrylic resin (b-1) whose main chain has, bonded thereto, at least two side chains of different lengths each having at least one hydroxyl group, a polyepoxide (b-2) and a crosslinking agent (b-3); and the clear coating composition (C) being a powder coating composition (C-1) or an organic solvent-based coating composition (C-2) comprising a hydroxyl- and carboxyl-containing resin (c-2*a*) and a polyepoxide (C-2*b*).

2. A method according to claim 1 wherein the first coating composition (A) has such a hiding power that a 15 μm thick cured coating of the composition (A) has a light transmittance of 3% or less in the wavelength range of 400 to 700 nm.

3. A method according to claim 1 wherein the second coating composition (B) is a composition that forms a colorless or colored clear coating, the composition (B) having a such a transparency that a 15 $\mu$m thick cured coating of the composition (B) has a light transmittance of about 30 to 100% in the wavelength range of 400 to 700 nm.

4. A method according to claim 1 wherein, of the at least two side chains bonded to the main chain of the acrylic resin (b-1), the difference in length between a side chain having a longer atomic chain between the hydroxyl group and the main chain, and a side chain having a shorter atomic chain between the hydroxyl group and the main chain, is 2 or more, in terms of the number of atoms constituting the side chains.

5. A method according to claim 1 wherein the acrylic resin (b-1) has a hydroxyl value of 50 to 200 mg KOH/g and a number average molecular weight of 3,000 to 50,000.

6. A method according to claim 1 wherein the powder coating composition (C-1) contains a glycidyl-containing acrylic resin and an aliphatic dibasic acid.

7. A method according to claim 1 wherein the hydroxyl- and carboxyl-containing resin (c-2*a*) has an acid value of 15 to 150 mg KOH/g.

8. A method according to claim 1 wherein the polyepoxide (c-2*b*) is a radical polymer containing an epoxy-containing ethylenically unsaturated monomer as a monomer component.

9. A method according to claim 1 wherein the substrate is an automobile body.

* * * * *